US012486072B1

(12) United States Patent
Everts et al.

(10) Patent No.: US 12,486,072 B1
(45) **Date of Patent: *Dec. 2, 2025**

(54) PULL TAB WITH IMPROVED ACCESSIBILITY AND ASSOCIATED METHODS OF MANUFACTURE

(71) Applicant: Intellectual Capital Management, Whitefish, MT (US)

(72) Inventors: Mitchell Everts, Whitefish, MT (US); Andrew Hogenkamp, Minster, OH (US)

(73) Assignee: Intellectual Capital Management, Whitefish, MT (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/733,452

(22) Filed: Jun. 4, 2024

Related U.S. Application Data

(63) Continuation-in-part of application No. 18/236,703, filed on Aug. 22, 2023.

(60) Provisional application No. 63/507,934, filed on Jun. 13, 2023, provisional application No. 63/507,938, filed on Jun. 13, 2023, provisional application No. 63/478,185, filed on Jan. 2, 2023.

(51) Int. Cl.
*B65D 17/347* (2006.01)
*B21D 22/02* (2006.01)
*B65D 17/28* (2006.01)

(52) U.S. Cl.
CPC ..... *B65D 17/347* (2018.01); *B21D 22/02* (2013.01); *B65D 17/4012* (2018.01)

(58) Field of Classification Search
CPC ..... B21D 51/383; B21D 22/02
See application file for complete search history.

(56) References Cited

U.S. PATENT DOCUMENTS

2005/0039314 A1* 2/2005 Dickie ..... B21D 51/383 29/418
2013/0075401 A1* 3/2013 Forrest ..... G09F 23/0091 413/56
2023/0150722 A1* 5/2023 Chiji ..... B21D 51/44 220/269

* cited by examiner

*Primary Examiner* — Mohammed S. Alawadi
(74) *Attorney, Agent, or Firm* — QuickPatents; Kevin Prince

(57) ABSTRACT

A pull tab for a container lid includes a nose configured to apply downward pressure on a frangible region of the container lid, a rivet receiving portion adjacent to the nose that includes a rivet aperture therethrough, a lift portion located distally from the nose, and a finger hole located in proximity to the lift portion. Side edges of the finger hole include one or more upward bends, placed such that the lift portion is elevated relative to a bottom plane of the pull tab, thereby facilitating user actuation of the pull tab and enabling efficient stacking of a plurality of the container lids during manufacturing thereof to facilitate shipment and storage thereof. An indentation formed in the container lid cooperative with the lift portion provides additional grasping space. Novel methods of manufacturing are also disclosed.

11 Claims, 13 Drawing Sheets

PULL TAB WITH IMPROVED ACCESSIBILITY AND ASSOCIATED METHODS OF MANUFACTURE

CROSS REFERENCE TO RELATED APPLICATIONS

This application is a Continuation-in-Part of U.S. Utility patent application Ser. No. 18/236,703, filed on Sep. 1, 2023, which claims the benefit of U.S. Provisional Patent Application 63/478,185, filed on Jan. 2, 2023, as well as U.S. Provisional Patent Application 63/507,934, filed on Jun. 13, 2023, as well as U.S. Provisional Patent Application 63/507,938, filed on Jun. 13, 2023, all being incorporated herein by reference.

STATEMENT REGARDING FEDERALLY SPONSORED RESEARCH AND DEVELOPMENT

Not Applicable.

FIELD OF THE INVENTION

This invention relates to containers, and more particularly to improvements in containers opened by a pull tab.

Pull tabs have long served as essential mechanisms for accessing beverages, canned foods, and other sealed products. A conventional pull tab is designed with a rivet hole and a receiving portion, which together anchor the tab firmly to the container's lid. Additionally, it features a distinct nose that exerts the right amount of pressure to break the container's seal, and a lift section where users apply force to engage the nose.

The original ring-pull tab design from the 1960s presented certain challenges; primarily, the detached rings became environmental nuisances and potential safety hazards. Recognizing these concerns, the 1970s introduced the stay-on-tab design—a design where the tab remains attached to the can post-opening. While this design significantly reduced litter and safety issues, its flat orientation against the container's lid often made it challenging for certain users to grasp, especially those with limited dexterity or strength.

Against this backdrop, there is a clear and pressing need for a pull tab design that seamlessly combines enhanced accessibility with a design that doesn't stray too far from the tried and tested manufacturing methods. The objective is to offer a design innovation without ushering in complexities in production or surges in costs. The present invention stands as a testament to this vision, bringing forth a fresh perspective while staying rooted in pragmatic considerations. The present invention accomplishes these objectives.

SUMMARY OF THE INVENTION

The present device is a pull tab for opening a container of the type having a frangible region of a container lid and a rivet aperture adjacent to the frangible region. The pull tab comprises a nose configured to apply downward pressure on the frangible region of the container lid, a rivet receiving portion adjacent to the nose that includes a rivet aperture therethrough, a lift portion located distally from the nose, and a finger hole located in proximity to the lift portion.

One or more upward bends are situated on each of two opposing sides of the finger hole of the pull tab. The upward bends are placed such that the lift portion is elevated relative to a bottom plane of the pull tab, with a topmost point of the lift portion being positioned at a distance of preferably between 1 mm and 2 mm from the bottom plane of the pull tab. As such, user actuation of the pull tab is facilitated and efficient stacking of a plurality of the container lids during manufacturing thereof is achieved.

Preferably the one or more upward bends are situated between 1 mm and 6 mm from the lift portion of the pull tab. The upward bends at the two opposing sides of the finger hole are each set at angles of between 1 and 50 degrees, but most preferably between 30 and degrees. The lift portion is preferably elevated above a top plane of the pull tab at a height of between 0.1 mm and 0.9 mm, and a center bar disposed between the nose and the lift portion has a minimum thickness of at least 1.9 mm. A length of the pull tab from the nose to the lift portion is between 20 mm and 25 mm. Optionally, a logo may be stamped or embossed onto the center bar during the manufacturing process.

In some embodiments, the invention includes the container lid and is adapted to fit over an open top end of the container. The container lid includes a cover having a peripheral edge that fits around and is mechanically fixed with the top end of the container to seal the container. The cover is preferably substantially flat. A rivet fixes the pull tab at the rivet aperture of the rivet receiving portion to the cover at the rivet apertures of the container lid. Other mechanical fasteners may be used instead of the rivet as is known in the art. In some embodiments, the cover includes an indentation that provides more space between the container lid and the lift portion to facilitate actuation of the pull tab. In some embodiments, the container, the container lid, and the pull-tab are all included in the product offered to the customer.

In some embodiments, a progressive die manufacturing method includes the steps of producing a tab blank in a first die stamping process, and forming the tab blank into a flat tab at a tab die. The flat tab has the nose configured to apply downward pressure on the frangible region of the container lid. The rivet receiving portion is formed adjacent to the nose and includes the rivet aperture therethrough. The lift portion is formed distally from the nose, and the finger hole is located proximately to the lift portion.

Then a lift station bends the flat tab upward at the two opposing sides of the finger hole such that the lift portion is elevated relative to the bottom plane of the pull tab. In some embodiments the lift station is integrated at an end of the tab die. Preferably in such embodiments the lift station is modular and can be interchanged with an alternate lift station having different bend angles, as desired. In some embodiments, a logo or other indicia is stamped or embossed onto the center bar of the pull tab.

The finished pull tab is assembled to one of the container lids by utilizing a rivet or like mechanical fastener. The container is filled with a liquid such as a beverage, and the container lid is affixed to the top open end of the container. In this way the container is sealed and ready to package, transport, and display for sale or the like.

The present invention is a pull tab design that combines enhanced accessibility with a design that doesn't stray too far from the tried and tested manufacturing methods. The present pull tab, in conjunction with a cooperative indentation in the container lid, provides additional room to facility grasping of the lift portion of the pull tab by a user. Space is provided for stamping a logo or other marketing message on the pull tabs, and such pull tabs of the present invention can be pre-assembled with container lids that are nestable to facilitate storage and transportation. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
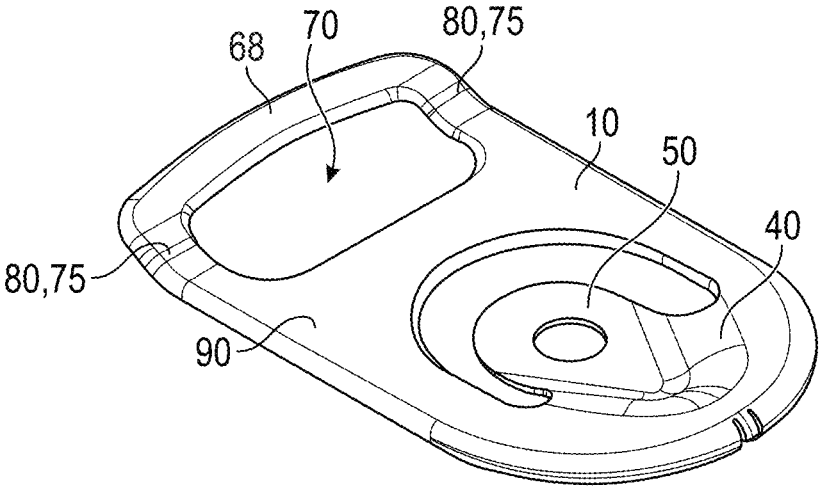
FIG. 1 is a perspective view of a first embodiment of a pull tab of the invention.
Figure 2:
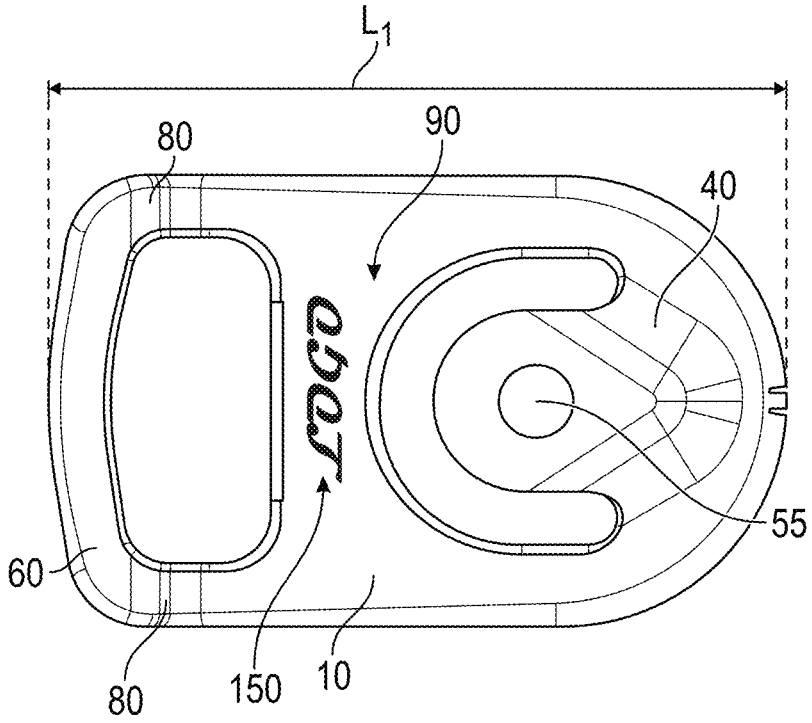
FIG. 2 is a top plan view thereof.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-3, 8 and 9 illustrate a pull tab 10 for opening a container 30 of the type having a frangible region 24 of a container lid 20 and a rivet aperture 26 adjacent to the frangible region 24.

The pull tab 10 comprises a nose 40 configured to apply downward pressure on the frangible region 24 of the container lid 20, a rivet receiving portion 50 adjacent to the nose 40 that includes a rivet aperture 55 therethrough, a lift portion 60 located distally from the nose 40, and a finger hole 70 located in proximity to the lift portion 60.

One or more upward bends 80 are situated on each of two opposing sides 75 of the finger hole 70 of the pull tab 10. The upward bends 80 are placed such that the lift portion 60 is elevated relative to a bottom plane Pb of the pull tab 10, with a topmost point 68 of the lift portion 60 being positioned at a distance D1 (FIG. 5) between 1 mm and 2 mm from the bottom plane Pb of the pull tab 10. As such, user actuation of the pull tab 10 is facilitated and efficient stacking of a plurality of the container lids 20 (FIG. 4) during manufacturing thereof is achieved.

Figure 3:
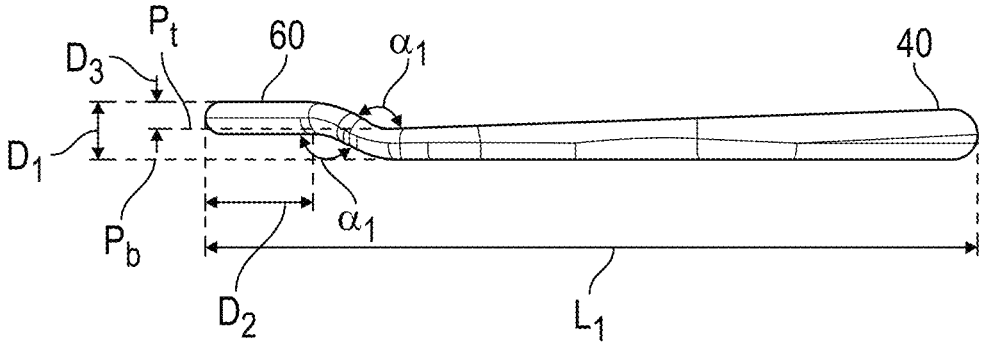
FIG. 3 is a side elevational view thereof.
Figure 6:
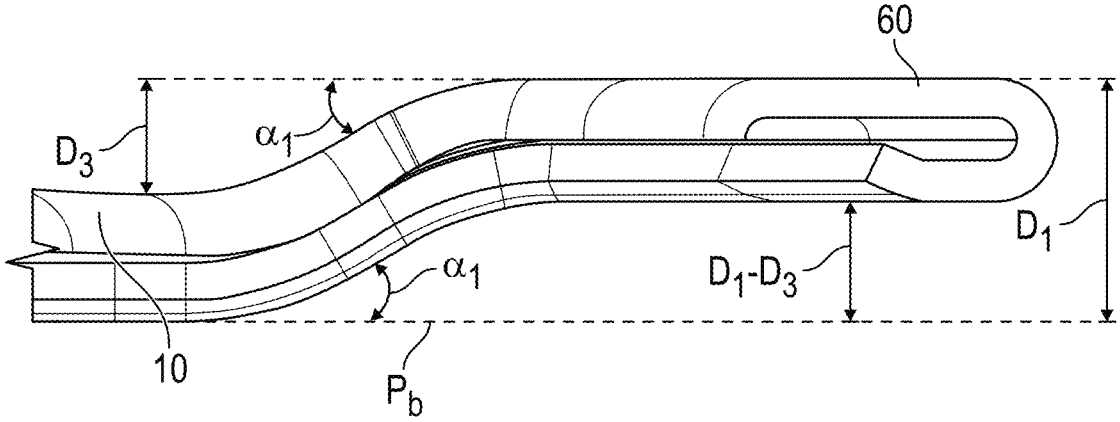
FIG. 6 is an enlarged partial elevational view thereof.
Figure 7:
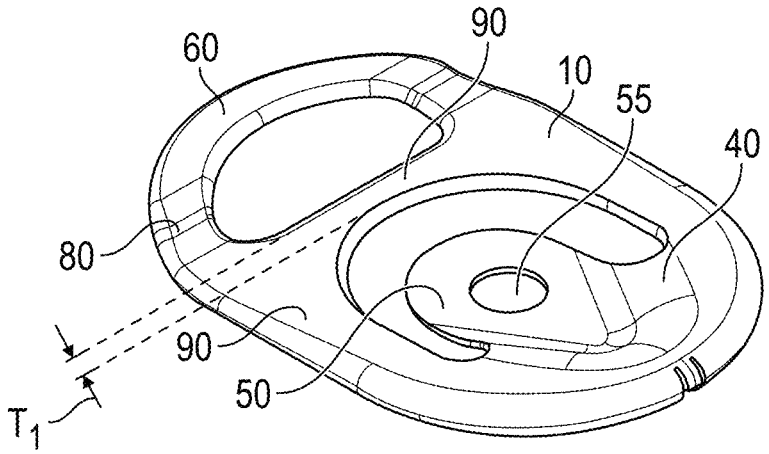
FIG. 7 is a perspective view of an alternate embodiment of the invention.
Figure 8:
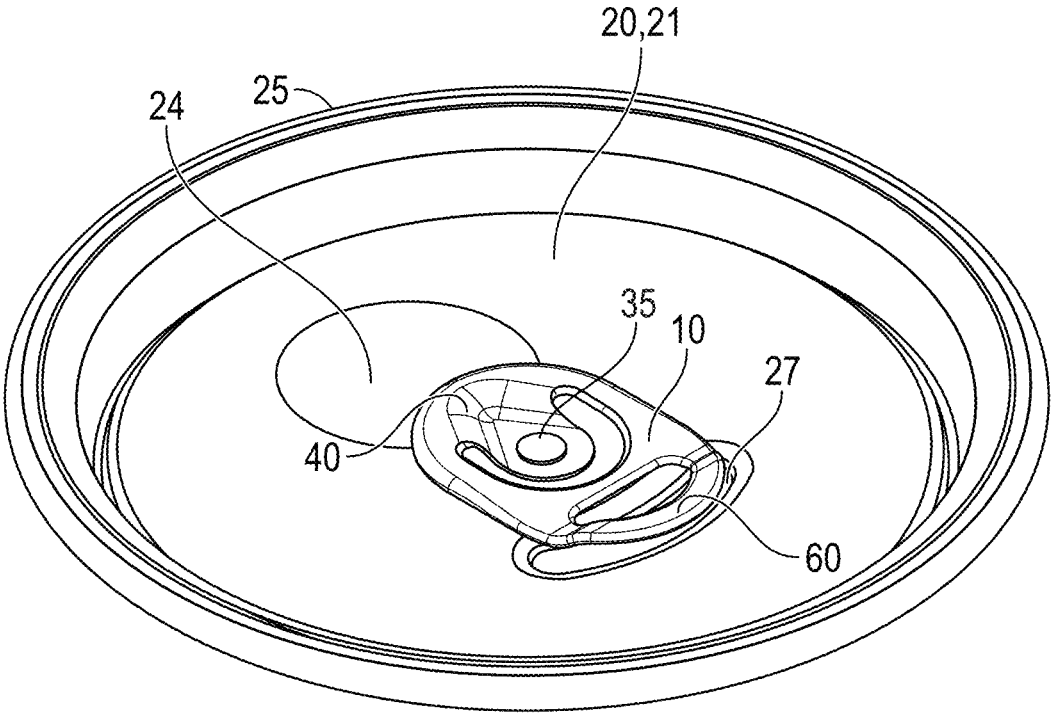
FIG. 8 is a top perspective view of a can lid of the present invention.
Figure 9:
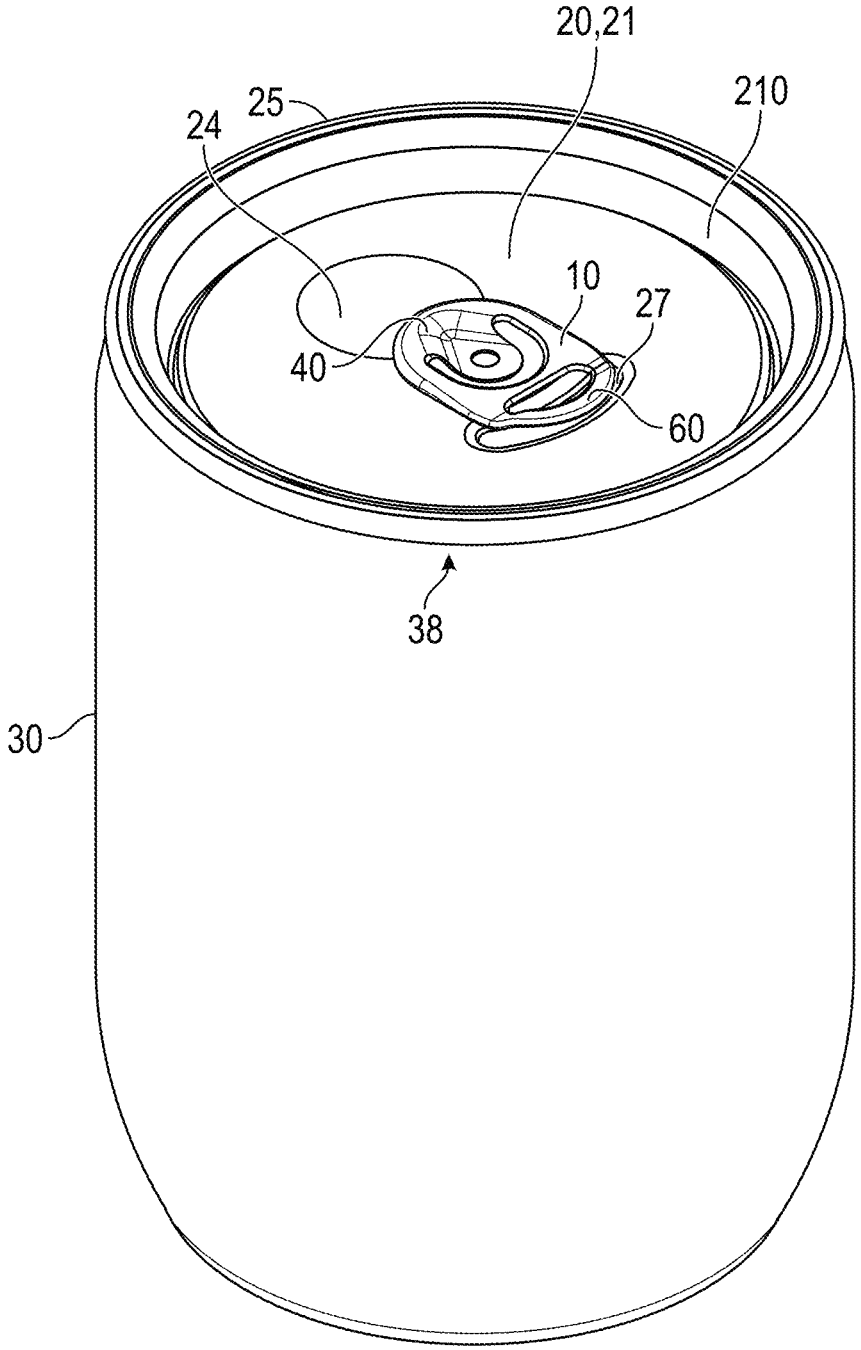
FIG. 9 is a top perspective view of a container that is sealed with the can lid of FIG. 8.
Figure 10:
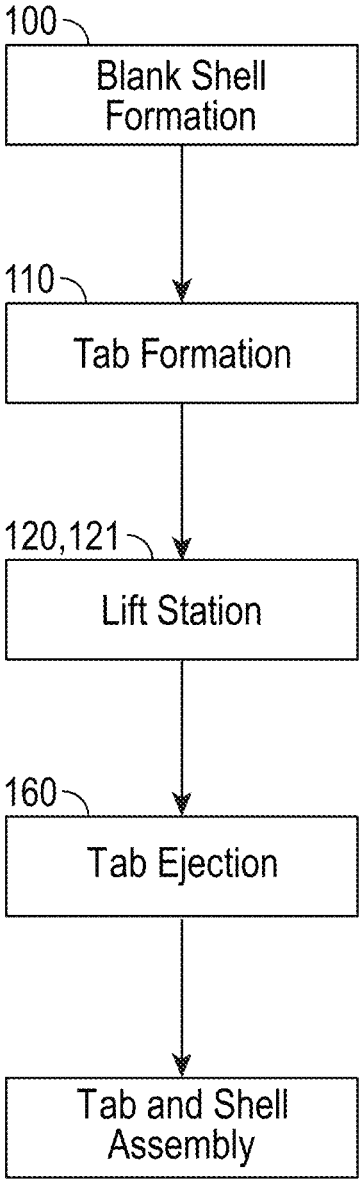
FIG. 10 is a diagram of a method of manufacturing the pull tab of the invention.

Preferably the one or more upward bends 80 are situated between 1 mm and 6 mm from the lift portion 60 of the pull tab 10 (FIG. 3). The upward bends 80 at the two opposing sides 75 of the finger hole 70 are each set at angles A1 of between 1 and 50 degrees (FIG. 6), but most preferably between 25 and 40 degrees. The lift portion 60 is preferably elevated above a top plane Pt of the pull tab 10 at a height D3 of between 0.1 mm and 0.9 mm, and a center bar 90 disposed between the nose 40 and the lift portion 60 has a minimum thickness of T1 (FIG. 7) of at least 1.9 mm. A length L1 of the pull tab 10 from the nose 40 to the lift portion 60 is between 20 mm and 25 mm. Optionally, a logo 150 (FIG. 2) may be stamped or embossed onto the center bar 90 during the manufacturing process.

In some embodiments, the invention includes the container lid 20 (FIGS. 4 and 8) and is adapted to fit over an open top end 38 (FIG. 9) of the container 30. The container lid 20 includes a cover 21 having a peripheral edge 25, or curl, that fits around and is mechanically fixed with the top end 38 of the container 30 to seal the container 30. A rivet 35 fixes the pull tab 10 at the rivet aperture 55 of the rivet receiving portion 50 to the cover 21 at the rivet apertures 26 of the container lid 20. Other mechanical fasteners may be used instead of the rivet 35 as is known in the art. In some embodiments, the cover 21 includes an indentation 27 (FIG. 4) that provides more space between the container lid 20 and the lift portion 60 to facilitate actuation of the pull tab 10. In some embodiments, the container 30, the container lid 20, and the pull-tab 10 are all included in the product offered to the customer.

FIGS. 10-13 illustrate methods of manufacturing the pull tab 10. In some embodiments, a progressive die manufacturing method includes the steps of producing a tab blank 100 in a first die stamping process, and forming the tab blank 100 into a flat tab 110 at a tab die. The flat tab 110 has the nose 40 configured to apply downward pressure on the frangible region 24 of the container lid 20. The rivet receiving portion 50 is formed adjacent to the nose 40 and includes the rivet aperture 55 therethrough. The lift portion 60 is formed distally from the nose 40, and the finger hole 70 is located proximately to the lift portion 60.

Figure 11:
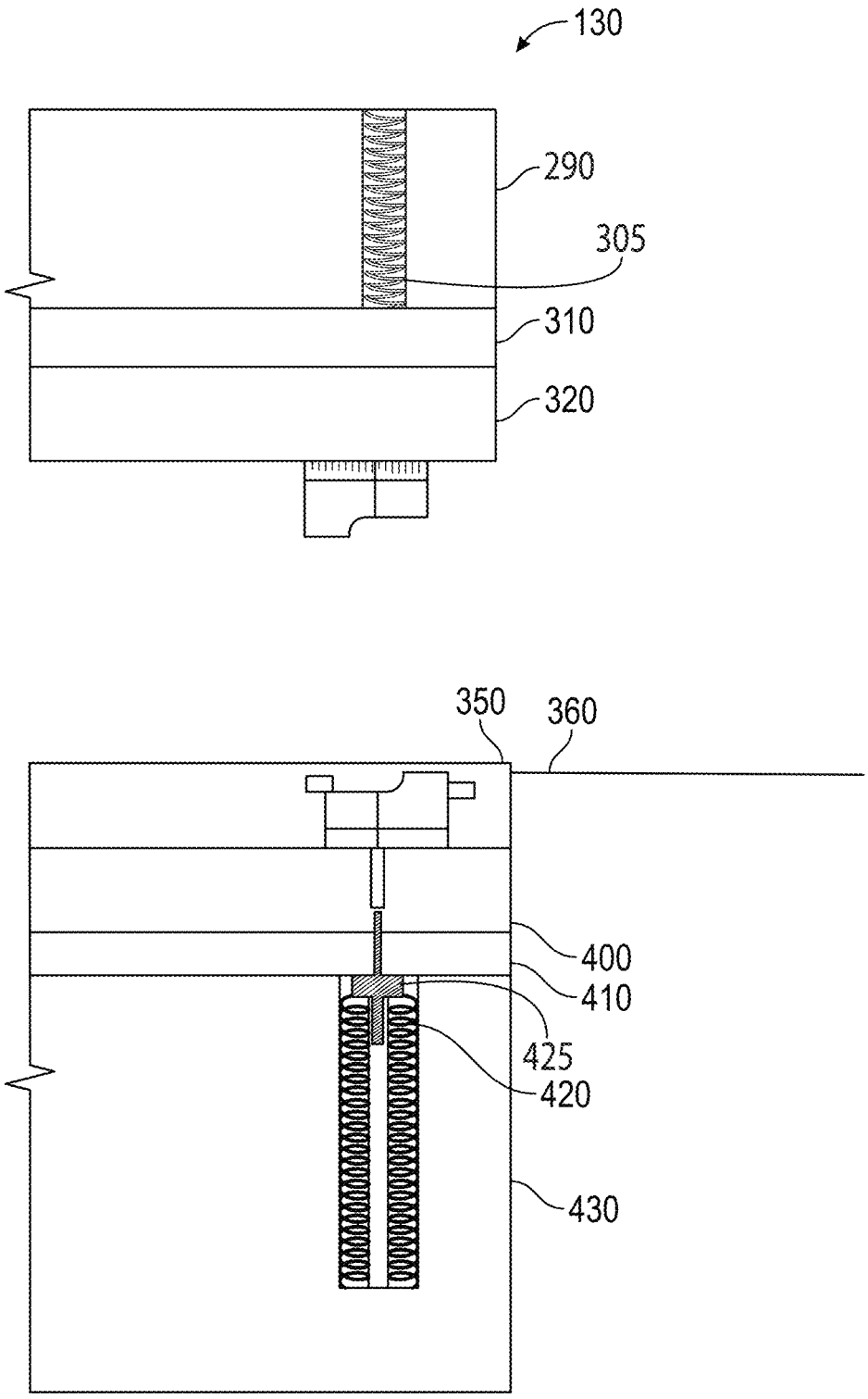
FIG. 11 is a diagram of a tab die in a conversion press used to manufacture the pull tab of the invention.

Then a lift station 120 bends the flat tab 110 upward at the two opposing sides 75 of the finger hole 70 such that the lift portion 60 is elevated relative to the bottom plane Bp of the pull tab 10. In some embodiments the lift station is integrated at an end of the tab die 130 (FIG. 11). Preferably in such embodiments the lift station 120 is modular and can be interchanged with an alternate lift station 120 having different bend angles A1, or the like, as desired. In some embodiments, a logo or other indicia is stamped or embossed onto the center bar 90 of the pull tab 10.

The finished pull tab 10 is then transferred to a Stake Station of the lane die using the scrap skeleton where it is assembled to one of the container lids 20 by utilizing a rivet 35 or like mechanical fastener. The container 30 is filled with a liquid such as a beverage, and the container lid 20 is affixed to the top open end 38 of the container 30. In this way the container 30 is sealed and ready to package, transport, and display for sale or the like.

Figure 4:
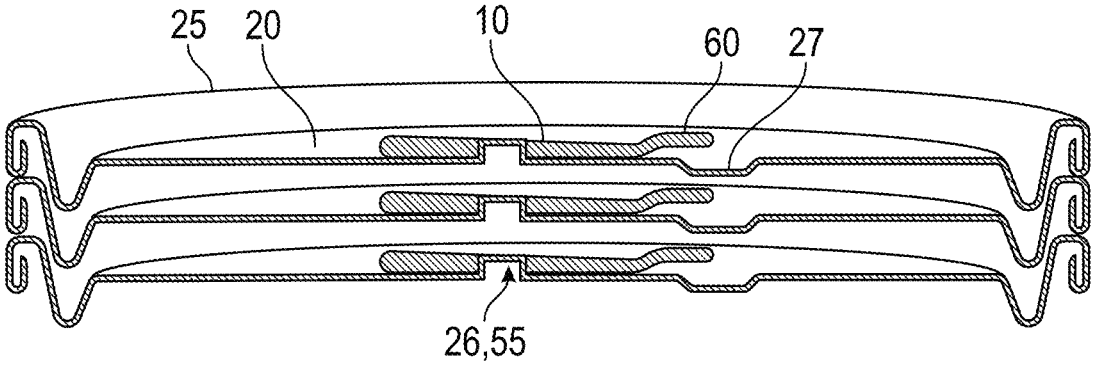
FIG. 4 is a cross-sectional view of a stack of nested container lids each including the pull tab of the invention.
Figure 5:
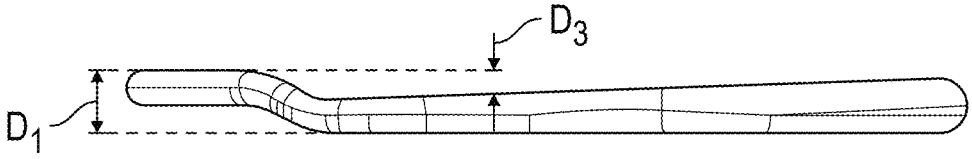
FIG. 5 is a side elevational view thereof.
Figure 12:
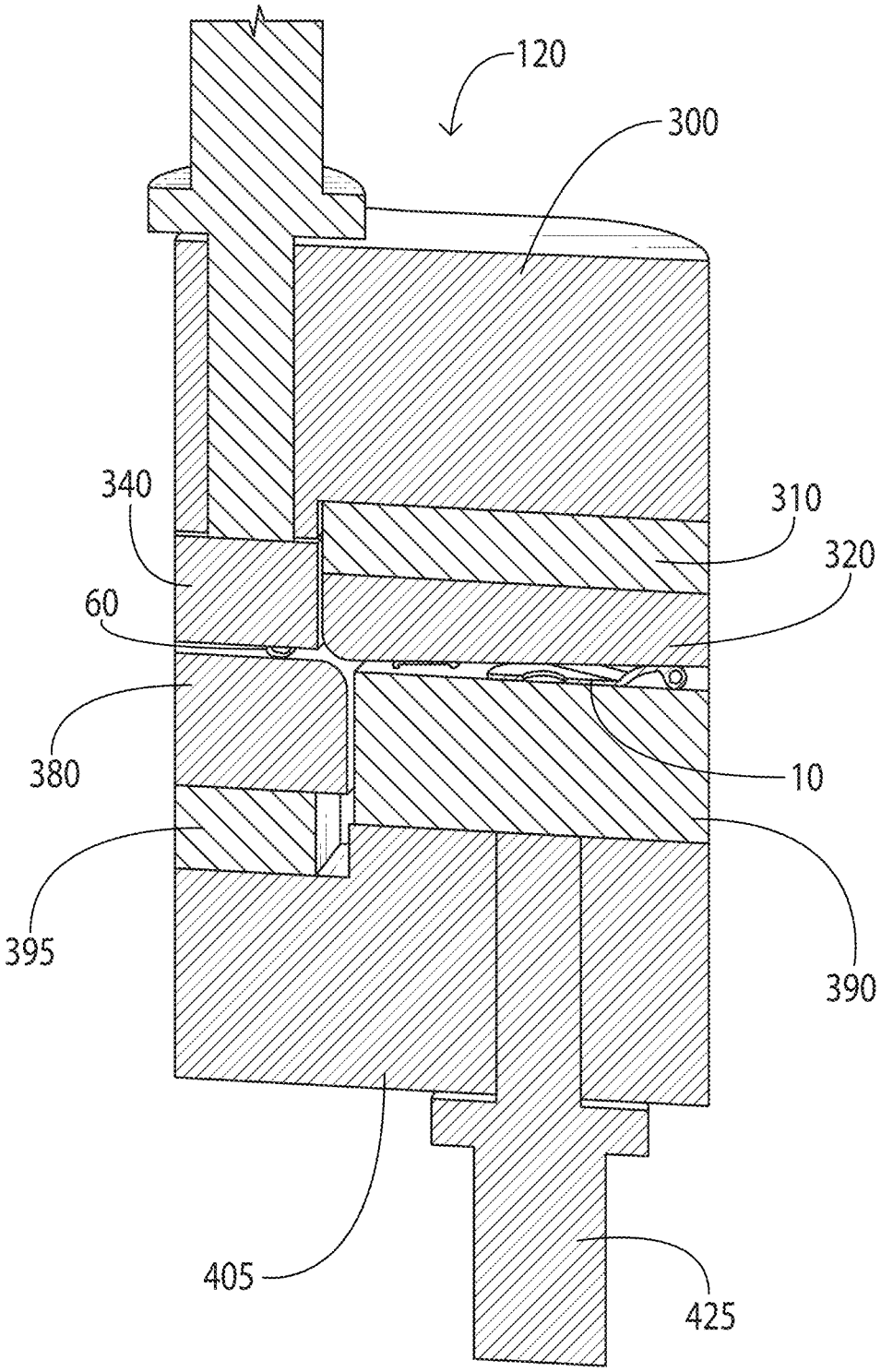
FIG. 12 is a cross-sectional view of a lift station used to form the upward bends in the pull tab.
Figure 13:
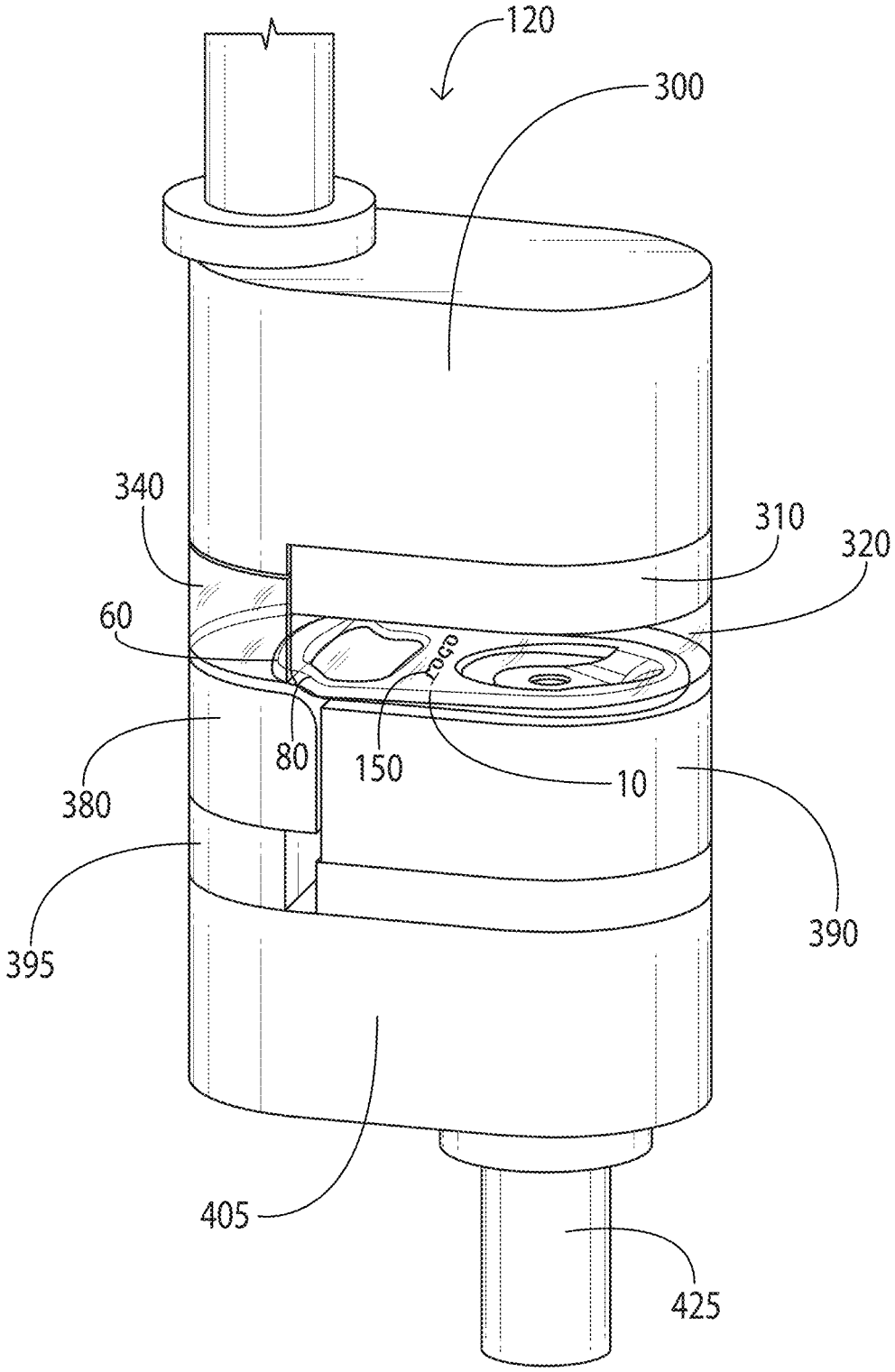
FIG. 13 is a perspective view of the lift station of FIG. 11, illustrated with some parts omitted for clarity of illustration.

Now going into more detail, in FIGS. 12 and 13, showing a conversion press, the tab die is where a raw tab stock is shaped into a final tab 10 before being fastened onto a converted container lid 20. The Lane Die, a type of transfer die, forms the blank shells 100 with integrated rivets, scores, and paneling across several stations. The tabs and shells come together at a staking station (not shown), where the tabs 10 are riveted onto the shell or container lid 20 to create a converted end, a stack of which is illustrated in FIG. 4.

To maximize finger accessibility of the user, the lift portion 60 of the pull tab 10, that is proximate to where the finger hole 70 is located, is formed or bent upwardly, creating additional room for a consumer's finger to reach under the lift portion 60 of the pull tab 10 and open the container 30. The lift station 120 may be added to the end of the tab die or incorporated into the tab reform station of current tab die embodiments to introduce this bend at the finger hole sides 75 of a fully-formed pull tab 10. The tab-bending or lift station 120 incorporates an upper pressure pad 340 and a lower pressure pad 390, which secures the flat tab 110 during the bending process. An upper assembly of the station includes an upper die shoe 290, an upper spring 305 an upper spring retainer plate 310, a punch retainer 320, upper bender punch 300, upper bender punch insert spacer 310, upper bender punch insert 320. The upper die shoe 290 is secured to a press slide (or ram), housing all of the upper tooling. This upper die shoe is guided by linear bearings, aligning accurately with a lower die shoe 430.

The lower assembly, in comparison, consists of the lower die shoe 430, a lower spring 420, a lower spring pin 425, a lower spring retainer plate 410, a die retainer 400, lower bender die 405, lower bender die insert spacer 395, lower bender die insert 380, and a lower bender die pressure pad 390. The lower die shoe 430 attaches to a press bed, aligning the lower tooling with the upper assembly using linear bearings.

The lower tab bender pressure pad 390 is spring-loaded, stripping the tab from the lower tooling 380 and returning the stock to the standard pass line 360. Grind spacers in both upper and lower tooling 310 and 395, respectively, allow for height adjustments of the tooling, ultimately influencing the final shape of the bent pull tab 10. This station is added after the Tab Reform station—presently the last station in the tab die—extending the complete length of the tab die by 1-2 progression lengths of the tab depending on the size constraints of the tooling.

The manufacturing process commences with the "Blank Shell 100 Formation". During this stage, blank shells 100 are created, integrating a rivet 35, score, and paneling, executed in multiple stations of the Lane Die.

In parallel or at the same time as the blank shell formation, the "Tab Formation" phase is initiated. At this stage, tab stock material is meticulously fashioned into the final tab design using the Tab Die.

Post the tab formation, an essential "Lift Station" process is performed. Depending on the method employed, this lift station may be added to the end of the tab die or incorporated into the existing tab reform station in the tab die. The station is responsible for meticulously crafting the upward bends on the finger hole sides of the tab, giving rise to a raised lift end. This specific feature augments user comfort and convenience during the can-opening process.

Finally, during the "Tab/Shell Assembly" phase, the innovative pull tab is securely attached to the shell using an integrated rivet at the Stake Station.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A progressive die manufacturing method of manufacturing a pull tab for opening a container of a type having a frangible region of a container lid and a rivet aperture adjacent the frangible region, comprising steps of:

producing a tab blank in a first die stamping process;

at a tab die, forming the tab blank into a flat tab having a nose configured to apply downward pressure on the frangible region of the container lid, a rivet receiving portion adjacent to the nose that includes a rivet aperture therethrough, a lift portion located distal from the nose, and a finger hole located in proximity to the lift portion; and at a lift station, bending the flat tab upward at two opposing sides of the finger hole to form upward bends such that the lift portion is elevated relative to a bottom plane of the pull tab, the lift portion being positioned at a distance between 1 mm and 2 mm from the bottom plane of the pull tab.

2. The method of claim 1 wherein the lift station is integrated at an end of the tab die.

3. The method of claim 1 wherein the lift station is a modular lift station that is configured to be interchanged with an alternate lift station.

4. The method of claim 1 further including the step:

the lift station creates the bends in the flat tab at angles between 1 and 50 degrees.

5. The method of claim 1 further including the step:

the lift station creates the bends in the flat tab between 1 mm and 6 mm from the lift portion of the pull tab.

6. The method of claim 1 further including the steps:

the tab die forming a center bar of the pull tab disposed between the nose and the lift portion having a minimum thickness of at least 1.9 mm; and stamping or embossing a logo on the center bar of the pull tab.

7. The method of claim 1 wherein said one or more upward bends are situated between 1 mm and 6 mm from the lift portion of the pull tab.

8. The method of claim 1 wherein said upward bends of the two opposing sides of the finger hole of the pull tab are each set at angles of between 1 and 50 degrees.

9. The method of claim 1 wherein the lift portion is elevated above a top plane of the pull tab at a height of between 0.1 mm and 0.9 mm.

10. The method of claim 1 wherein a center bar of the pull tab is disposed between the nose and the lift portion and has a minimum thickness of at least 1.9 mm.

11. The method of claim 1 wherein a length of the pull tab from the nose to the lift portion is between 20 mm and 25 mm.

* * * * *